US005243566A

United States Patent [19]

Anderson

[11] Patent Number: 5,243,566

[45] Date of Patent: Sep. 7, 1993

[54] LOW NOISE TRANSDUCER SYSTEM

[75] Inventor: Phillip R. Anderson, Ellicott City, Md.

[73] Assignee: Westinghouse Electric Corp., Pittsburgh, Pa.

[21] Appl. No.: 461,334

[22] Filed: Apr. 16, 1974

[51] Int. Cl.[5] ..... H04R 23/00

[52] U.S. Cl. ..... 367/153; 310/337; 367/172; 367/176

[58] Field of Search ..... 340/8 R, 9, 10, 11, 340/14; 310/8.2, 337; 367/153, 155, 156, 162, 167, 172, 176

[56] References Cited

U.S. PATENT DOCUMENTS

| | | | |
|---|---|---|---|
| 2,427,062 | 9/1947 | Massa | 340/10 |
| 2,768,364 | 10/1956 | Camp | 340/10 X |
| 2,906,993 | 9/1959 | Steinberger | 340/8 PC |
| 3,082,401 | 3/1963 | Bland et al. | 340/9 X |
| 3,277,434 | 10/1966 | Buchanan | 340/9 X |
| 3,372,370 | 3/1968 | Cyr | 340/8 PC |
| 3,492,634 | 1/1970 | Massa | 340/9 |

*Primary Examiner*—Harold J. Tudor
*Attorney, Agent, or Firm*—L. A. DePaul

[57] ABSTRACT

An acoustic array of special utility in deep operating antisubmarine torpedoes comprises a plurality of individual transducer elements supported by a back-plate member. An acoustic window made of an elastomeric or plastic material is mounted against the front faces of the transducer elements and forms part of the waterproof housing of the torpedo. The backplate provides abuttive support to the transducer elements against crush pressure exerted by ambient water against the acoustic window. Inserts, made of an acoustic decoupling material which exhibits high crush strength characteristics, are interposed between each transducer element and the backplate. The backplate is made of body sections having interposed therebetween very thin layers of a compliant material, with the layers bondingly confined between the body sections. The compliant material is chosen to be of a type which damps acoustic vibrations which may be present in the backplate by the mechanism of "coulomb friction damping".

8 Claims, 2 Drawing Sheets

LOW NOISE TRANSDUCER SYSTEM

BACKGROUND OF THE INVENTION

This invention relates to underwater acoustic transducer arrays, and more particularly to the structural features thereof which decouple undesired vibrations borne by the structure to which the array is mounted.

In most sonar systems it is important that the lowest receive level be limited by a physical phenomenon beyond man's control at that particular time and state-of-the-art. For torpedoes moving through the water at high speed, the natural generation of noise by water flowing over the face of the transducer should be a limiting level.

Prior efforts in decoupling vibrational noises borne by the support structure were principally aimed at reducing the effect of element to element mutual coupling caused by the support structure during projection of acoustic energy from the transducer in its transmit mode. These efforts are illustrated by U.S. Pat. Nos. 3,492,633 and 3,492,634 to F. Massa. Prior to the present invention it was generally assumed that the noise appearing in the output of the transducers was induced by water flowing across the frontal face of the acoustic window over the array, or if caused by vibration induced in the shell, that the energy was coupled to the transducer by a water path. Not until the tests of the present invention was it recognized that decoupling of an additional order of magnitude beyond that necessary to provide isolation of transducer elements in the transmit mode is desirable.

SUMMARY OF THE INVENTION

An acoustic transducer array of special utility in deep operating homing torpedoes has features providing a significant improvement in acoustic isolation of the individual transducer elements from acoustic vibrations which are borne by the host structural member (e.g. the torpedo shell) to which the array is mounted. A backplate is the base member for supporting the individual transducer elements. The front faces of the transducer elements support an acoustic window made of an elastomer, or plastic material, against external water pressure. An acoustic isolator element made of an acoustic decoupling material is interposed between each transducer element and the backplate. The backplate member is constructed of several body sections. Thin layers of compliant material are sandwiched between the body sections, with both faces of each layer firmly bonded to adjacent body sections. The compliant material is chosen to be of a type which under special confinement between rigid members provides "coulomb friction damping" of acoustic vibrations which may be present in the rigid member. Such materials include most elastomers. A preferred thickness of the compliant material layers is of the order of 30 mils, or 0.76 millimeters. This enables the array organization to exhibit highly desired dimensional stability under the very large crush pressures to which it may be subjected at the deep end of the depth range of an antisubmarine homing torpedo. The front body section provides abuttive support to the transducer elements. The backplate is attached to the host structural member by a flange formed on a body section which is separated from the front body section by at least one layer of compliant material. The acoustic isolator elements are preferably of synactic foam which exhibits extremely high crush strengths. This construction provides a very significant improvement in acoustic isolation, while at the same time exhibiting dimensional stability and stability of acoustic impedance over the full range of depths which state-of-the-art antisubmarine torpedoes may encounter. As mentioned, dimensional stability is critical. The reason for this is that the front faces of the array of transducers provide the support to an elastomeric acoustic window against exterior water pressure. Deformation of the acoustic window would readily generate cavitation or increase turbulence at the torpedo nose, which would act as a new noise source.

DESCRIPTION OF THE PREFERRED EMBODIMENT

Figure 1:
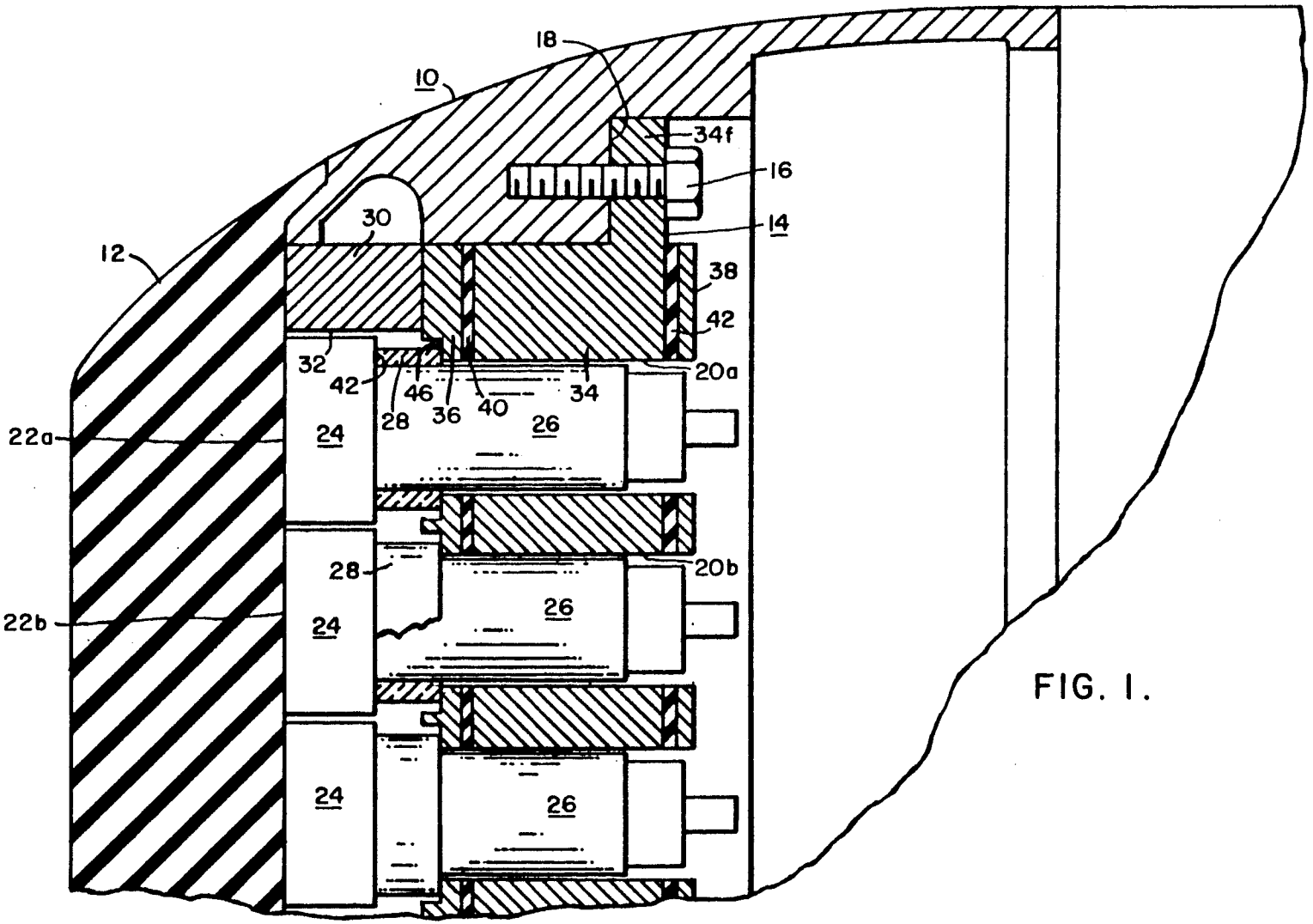
FIG. 1 is a section, partly in side elevation, taken along lines I—I of FIG. 2, of an acoustic transducer array embodying the present invention, shown in the environment of a nose of a homing torpedo.
Figure 2:
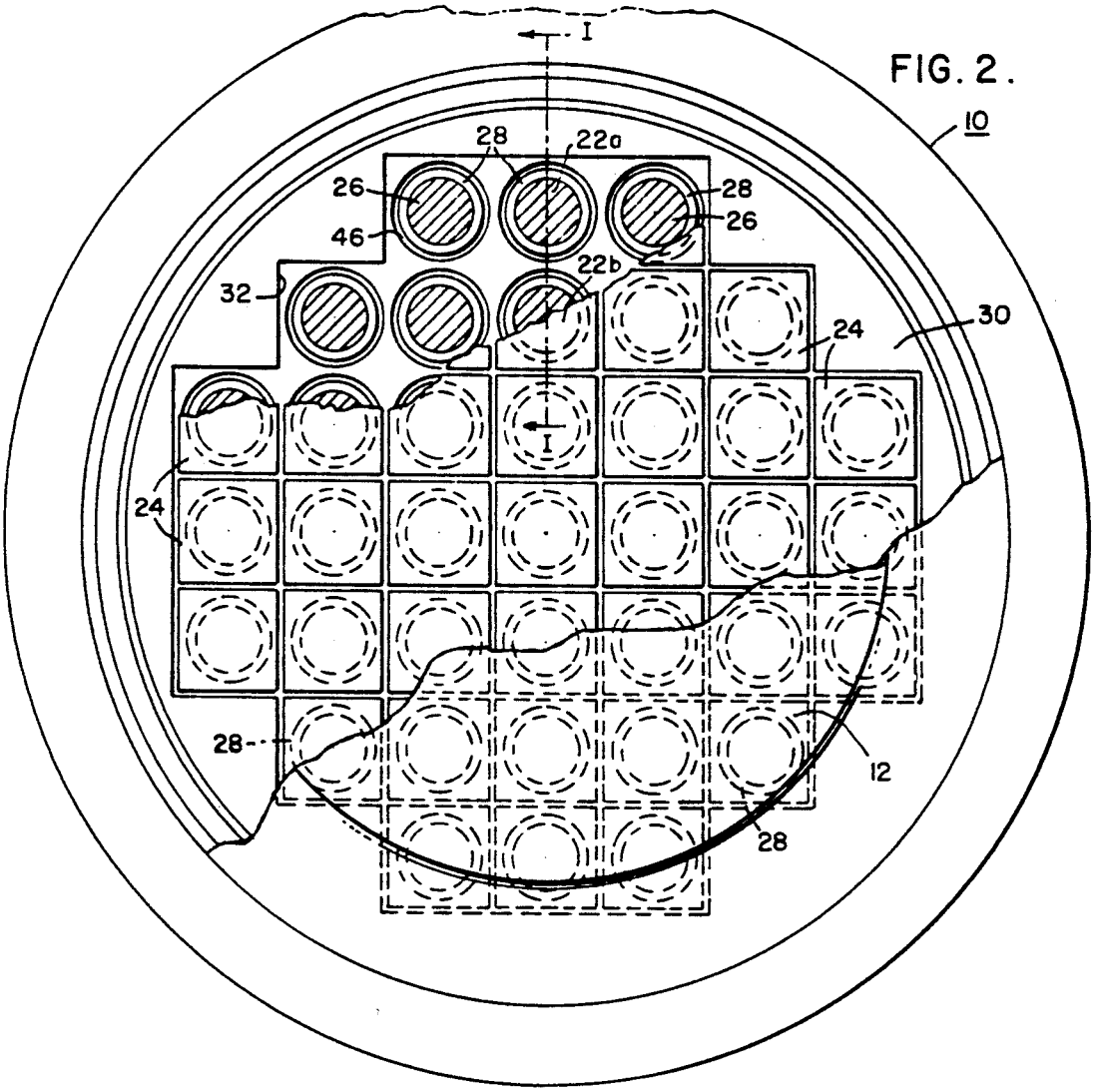
FIG. 2 is a front view of the torpedo, partly broken away to expose portions of the transducer array.

Referring more particularly to FIGS. 1 and 2 in conjunction with one another, the nose section of an acoustic homing torpedo contains a transducer array embodying the present invention. The array depicted in the drawing is especially suitable for homing torpedoes designed for deep operation in which extreme differential pressures are encountered between the ambient water medium and the torpedo interior.

A torpedo shell 10 is made of metal or fiberglass and has a symmetrical shape about the longitudinal torpedo axis. Shell 10 is open at its front end and has an acoustic window 12 disposed across the opening. Window 12 forms a part of the water resistance torpedo housing. A backplate member 14 is affixed by means of a number of bolts, including bolt 16 to a flange surface 18 formed along the interior of shell 10. Backplate member 14 is constructed of a number of axial sections, which will be described in greater detail in a later paragraph of this specification. A grid of circular apertures 20*a*, 20*b*, etc., extend through backplate member 14. Mounted within the apertures are a like series of transducer elements 22*a*, 22*b*, etc. Each element 22 is of conventional type including a frontal, enlarged head portion 24 and a tail portion 26 which extends rearwardly through the corresponding aperture 20. Before the transducer is mounted to the backplate member 14, an acoustic isolator sleeve 28 is slipped over the tail portion. The sleeve is larger than the diameter of the aperture so that it is abuttingly confined between the shoulder formed at the junction of the head portion 24 and the tail portion 26 of the transducer element 22, and the front face of the backplate member 14. The purpose served by sleeve 28 and detailed features of its mounting will be amplified upon in a later paragraph of this description. Backplate member 14 is disposed transversely across the interior of the torpedo at an axial location which positions the front face of the head portion 24 of each transducer element 22 in direct contact with the rear face of acoustic window 12. A frame member 30 containing an aperture 32 is disposed between the rear face of acoustic window 12 and the front face of the backplate 14 with the radiating heads 24 projecting through the aperture. The transducer elements 22*a*, 22*b*, etc., in aggregrate constitute an array which projects the energy coupling beam pattern forward through window 12.

The backplate member 14 must be capable of withstanding the total force exerted on the exterior face of acoustic window 12 by water pressure at the deepest depth at which the torpedo is designed to operate. In typical state-of-the-art torpedoes this force is over 100,000 pounds. Backplate member 14 is an assembly of three body sections with thin layers of rubber therebetween. These sections are: a relatively thick middle section 34; a front septum section 36; and a rear septum section 38. Layers of rubber 40 and 42 are disposed between sections 36 and 34, and sections 34 and 38, respectively. Middle sections 34 is the strength member which provides the resistance to the previously described force of water pressure. A flange portion 34*f* is formed along the outer periphery thereof to provide the bolt holes for bolt 16 and the other mounting bolts. The layers of rubber 40 and 42, and the septum sections 36 and 38 which respectively engage the rubber layers have a function in decoupling the transducer from noises borne by torpedo shell 10. This will be amplified upon in a paragraph later herein which describes the operation of the apparatus in the receive mode of the array. The layers of rubber 40 and 42 are bonded securely to the front and rear surfaces of middle section 34 with the bonded joints extending substantially over the full areas of their confronting faces, and similarly the septum sections 36 and 38 are firmly bonded to the other sides of the respective rubber layers. One means of forming the firm bond is to vulcanize the rubber to its adjacent septum section and the middle section. Another method of providing a firm bond is the use of epoxy glue. The septum sections 36 and 38 must be of sufficient thickness to provide rigid confinement of the rubber layers 40 and 42. In addition front septum section 36 must have sufficient structural strength to assure that the positioning of each transducer element can be controlled within desired dimensional tolerance. The front and rear rubber layers 40 and 42 are preferably as thin as possible without the possibility of metal-to-metal contact between the septum plates and the strength member. Metal-to-metal contact could result from the extrusion of the rubber from the interstices under the high pressure at deep depths. One successful operational embodiment employs a layer thickness of 30 mils, or 0.76 millimeters. As an alternative to making layers 40 and 42 of rubber, they may be made of other compliant materials such as synthetic rubbers and certain plastics which exhibit the property of damping acoustic vibrations when spatially confined between rigid members. In one successful operational embodiment, the body sections 34, 36 and 38 were constructed of aluminum, with middle section 34 having a thickness of approximately two inches. However, it is to be understood that many alternative materials for the body sections are permissible including heavier metals or fiberglass.

The acoustic isolator sleeves 28 have the function of acoustically decoupling the individual transducer elements 22 of the array from one another during the transmit mode of the array, and the function of acoustically decoupling the transducer elements from acoustic noise borne by backplate member 14 during the received mode of a sonar. Each sleeve 28 is made of syntactic foam, consisting of an epoxy resin having a filler of ceramic microspheres and cured to a hardened state. This material was chosen because its properties provide: (A) a large acoustic impedance mismatch at the interface between sleeve 28 and the shoulder 44 formed at the junction of the head portion 24 and the tail portion 26 of a transducer element 22; (B) a relatively low specific density which does not adversely load the head portions 24 so as to interfere with their ability to couple energy in the forward direction; and (C) compressive strength to retain dimensional stability under the extremely high forces exerted thereacross due to the force of water pressure acting on window 12. It is to be noted that although this material does not have the rigidity of a hard metal, the compliancy which it may exhibit is many orders of magnitudes lower relative to the compliancy of rubber layers 40 and 42 in the backplate member 14. Each isolator sleeve 28 constitutes an insert interposed between a surface 46 formed on the front face of front septum section 36 and the shoulder 44 on the associated transducer element 22. As such, each sleeve constitutes a means for coupling the transducer element 22 and the backplate member 14 for purposes of the abuttive support which member 14 provides in resisting the water pressure force, but for decoupling the transducer element 22 from the backplate member 14 against propagation of acoustic energy therebetween. The interface between isolator sleeve 28 and surface 44 also provides an acoustic impedance mismatch which adds to the effectiveness of the decoupling. The components involved in mounting the transducer elements are glued in position by epoxy glue, including the end face areas of sleeve 28 and backplate member 14, the end face areas of the sleeves 28 and shoulders 44, front faces of head portions 24 and the rear face of acoustic window 12, and the abutting surfaces of frame member 30 to acoustic window 12 and backplate member 14. In gluing these elements one to another they are positioned so that there is no lateral contact between the transducer elements 22, or sleeves 28, and backplate member 14. Only the transverse (relative to the torpedo axis) surfaces of these parts are in contact.

Figure 3:
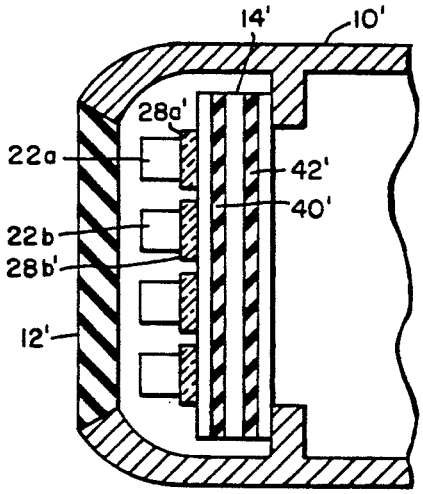
FIG. 3 is a diagrammatic representation of the relationships of abuttive support present in the transducer array apparatus of FIGS. 1 and 2.

Referring now to FIG. 3, a simplified diagrammatic of the apparatus just described includes a torpedo shell 10' acoustic window 12' and backplate 14' affixed to a flange surface of the shell 10'. The backplate member 14' contains layers of rubber 40', 42' confined between body sections of member 14'. Transducer elements 22*a'*, 22*b'*, etc. are mounted to the front face of the backplate member 14' with acoustic isolator inserts 28*a'*, 28*b'*, etc. interposed therebetween.

The operation of transducer array apparatus constructed in accordance with this invention will now be described relative to the receive mode of operation of a homing torpedo. The additional order of magnitude of decoupling provided by the present apparatus serendipitously produces improvements in the transmit mode. However, it is in the receive mode that the levels of signals with which the transducers are operating are at such low levels that they are affected by the noises borne by shell 10 and backplate member 14. These noises may be originated by the moving machinery rotating equipment contained in the torpedo, or may be generated by movement of the water over the shell of the torpedo. Either of these sources can be sufficiently high to prevent the receiver to which the array is connected from operating at its limit of sensitivity. The combination of noise reduction provided by the interposition of isolator sleeves 28 as inserts, and the use of a backplate member 14 having confined layers of rubber therein has provided a measured reduction in noise level of a transducer array of 15 to 20 db relative to similar transducers without the present structure It is believed that the suppression of excitation of acoustic waves in the backplate member 14 in response to shell borne noise transmitted therein is a significant factor in achieving this result. The confined layers of rubber are believed to provide this suppression by the physical phenomenon of so-called coulomb friction type damping. In accordance with the known theory, coulomb friction type damping occurs when certain compliant materials, including rubber, are confined between rigid confinement structures. It is the theory that the acoustic wave energy causes motion between particles of the compliant layer, and that this friction is converted to heat. The friction loss in turn damps the presence of acoustic waves in the body. More particularly, it is the combination of the reduction in vibrational level provided by layers 40 and 42 and decoupling the individual transducer elements 22 provided by the acoustic isolator sleeves 28 which reduces the self noise levels in the receiver.

Exhaustive testing of the acoustic properties of a transducer array built in accordance with the present invention have shown that its acoustic performance is not effected at great depths, or over wide temperature ranges. In addition there is minimal acoustic impedance variation as a function of the depth. The construction of backplate member 14 and the construction feature consisting of sleeves 28 interposed between transducer elements 22 and the front face of member 14 provide mechanical stability of the design as a function of depth. This is important in order to prevent deformation of the external configuration of acoustic window 12 at the window-shell interface. Deformation at this point would generate cavitations or increase the turbulence in the boundary layer which would act as a new flow noise sound source.

While the illustrative embodiments which has been described employs an isolator sleeve 28 of syntactic foam, other decoupling materials such as layers of onionskin paper, heavy metals, cloth, rubbers and plastics may be used, particularly if pressure is not a problem.

Also while the illustrative embodiment has been described in connection with piston-type transducer elements, it is readily apparent that the same concepts of isolation and damping can be applied to other transducer element configurations, such as spheres.

Similarly the isolation can be applied to other types of acoustic window applications such as acoustic windows which are oil coupled or pressure coupled to the transducer elements.

What we claim is:

1. In underwater acoustic array apparatus of the type including a plurality of transducer elements which are subjected to the force of external water pressure, an array backplate which is to be affixed to a host structural member and which provides the resist structure against the water pressure, and decoupler apparatus for decoupling undesired propagation of vibrational noises from the host structural member to the transducer elements, the decoupler apparatus comprising;

a) an array backplate unit having formed thereon a transducer element mounting face forming the resist surface to support said transducer elements against the force of external water pressure, b) a plurality of acoustic isolator inserts comprising one insert for each transducer element of said plurality of transducer elements, each insert being made of an acoustic decoupling material and being physically interposed between a different transducer element and the mounting face of the backplate member, said inserts being made of a material having sufficient crush resistance to resist dimensional deformation under the force of external water pressure, c) said array backplate unit comprising an arrangement of at least first and second rigid plate sections with a layer of damping friction generating material interposed between adjacent plate sections, and d) means for bonding each face of each layer of damping friction generating material between rigid plate sections to the confronting surface of the adjacent rigid plate section over essentially the entire interface area therebetween, whereby the damping friction generating material is confined between a rigid confinement structure to thereby provide Coulomb friction-type damping of vibrations within said array backplate unit.

2. Apparatus in accordance with claim 1, wherein;

a) said damping friction generating material is a rubber-like material.

3. Apparatus in accordance with claim 2, wherein;

a) said at least first and second rigid plate sections are made of metal.

4. Apparatus in accordance with claim 1, wherein;

a) said damping friction generating material exhibits a degree of compliancy more than two orders of magnitude greater than the compliancy of the material of which said isolator inserts are made.

5. Apparatus in accordance with claim 4, wherein;

a) said acoustic decoupling material is an epoxy resin intermixed with a filler of ceramic microspheres and cured to a hardened state.

6. Apparatus in accordance with claim 1, wherein;

a) each layer of damping friction generating material has a thickness of about no more than 30 mils.

7. Apparatus in accordance with claim 1, wherein;

a) said damping friction generating material is rubber, and b) said means for bonding each face of each layer of rubber to the respective confronting face of the adjacent rigid plate section comprises the vulcanization of the rubber to the adjacent rigid plate section.

8. Apparatus in accordance with claim 1, wherein;

a) said means for bonding each face of each layer of damping friction generating material to the confronting surface of the adjacent rigid plate section is an epoxy glue joint.

* * * * *